US005915644A

United States Patent [19]

Prittie

[11] Patent Number: 5,915,644

[45] Date of Patent: Jun. 29, 1999

[54] RETROFITTABLE OPERATING MODULE FOR WEB PROCESSING MACHINES AND THE LIKE

[75] Inventor: Allan R. Prittie, Islington, Canada

[73] Assignee: Arpeco Engineering Limited, Ontario, Canada

[21] Appl. No.: 08/923,432

[22] Filed: Sep. 4, 1997

Related U.S. Application Data

[60] Provisional application No. 60/025,536, Sep. 6, 1996.

[51] Int. Cl.[6] ..... B65H 35/02

[52] U.S. Cl. ..... 242/525.4; 242/538.2; 226/90; 226/177; 83/346; 83/564

[58] Field of Search ..... 242/525, 525.4, 242/526, 538.2, 522, 538.3; 226/90, 177; 83/346, 564

[56] References Cited

U.S. PATENT DOCUMENTS

| | | | |
|---|---|---|---|
| 1,693,589 | 12/1928 | Bolton | 83/342 |
| 3,014,775 | 12/1961 | Hoover | 346/77 R |
| 4,053,092 | 10/1977 | Edwards | 226/90 |
| 4,188,843 | 2/1980 | Dickey | 83/304 |
| 4,226,150 | 10/1980 | Reed | 83/346 |
| 4,553,461 | 11/1985 | Belongia | 83/344 |
| 4,974,784 | 12/1990 | Steidle | 242/56 R |
| 4,997,298 | 3/1991 | Uchimura et al. | 400/242 |
| 5,156,076 | 10/1992 | Rosemann | 83/344 |
| 5,467,678 | 11/1995 | Stollenwerk | 83/344 |
| 5,636,811 | 6/1997 | Crowther et al. | 242/535 |

FOREIGN PATENT DOCUMENTS

| | | | |
|---|---|---|---|
| 3729060 A1 | 3/1989 | Germany | 242/535 |
| 2049527 | 12/1980 | United Kingdom | 83/346 |

*Primary Examiner*—Donald P. Walsh
*Assistant Examiner*—Minh-Chau Pham
*Attorney, Agent, or Firm*—Shoemaker and Mattare, Ltd.

[57] ABSTRACT

A module for a web-processing machine includes a sub-frame to which are mounted an operating roll (such as a die roll), and means urging the operating roll in one direction. The sub-frame can assume a position in which the operating roll is juxtaposed against and parallel with a driven anvil roll, and a further position in which the sub-frame is released, allowing the operating roll to move away from the anvil roll, so that the operating roll can be quickly and easily removed for replacement or maintenance. Preferably, the sub-frame is hingedly connected to the machine for rotation between the above positions.

16 Claims, 5 Drawing Sheets

RETROFITTABLE OPERATING MODULE FOR WEB PROCESSING MACHINES AND THE LIKE

This application claims benefit of U.S. Provisional application Ser. No. 60/025,536 filed Sep. 6, 1996.

This invention relates to machines which perform various operations on a moving web as the web unwinds from a first mandrel (the unwind mandrel) and winds up on a second mandrel (the rewind mandrel). The invention has to do particularly with a module which may be installed as part of the original machine, or retrofitted to existing machines. The module is designed to facilitate the task of removing a rotary tool, such as a die roll, for replacement or maintenance, the rotary tool being at an intermediate location in a concatenation of rolls. In the absence of the module, the rolls would have to be completely disassembled, a process which is both cumbersome and time-consuming.

GENERAL DESCRIPTION OF THE INVENTION

The module disclosed herein is useful with a variety of machines that perform various operations on a moving web. Such machines may include: an embossing machine, an inspection machine (for inspecting and repairing the web), a printer, a diecutter machine and a hot stamping machine.

More particularly, this invention provides a module for use on a web-processing machine adapted to carry out operations on a moving web uncoiling from an unwind mandrel and coiling up on a rewind mandrel, the machine having a main frame and further having rolls which define a web path, said rolls including a driven anvil roll mounted on said main frame, an operating roll which is parallel with and juxtaposed against the anvil roll, and urging means for urging the operating roll against the anvil roll; the module comprising:

a sub-frame to which are mounted said operating roll and said urging means; and releasable securement means which in a first condition holds said sub-frame in a position in which the operating roll is juxtaposed against and parallel with the anvil roll, and which in a second condition releases the sub-frame and operating roll, allowing the operating roll to move away from the anvil roll to a position wherein the operating roll is directly accessible can be quickly and easily removed for replacement or maintenance, without having to dismantle said urging means.

Further, this invention provides a web-processing machine adapted to carry out operations on a moving web, the machine comprising:

an uncoiling mandrel and a rewind mandrel disposed such that the web can uncoil from the unwind mandrel and coil up on the rewind mandrel, a main frame, a plurality of rolls which define a web path between said mandrels, said rolls including a driven anvil roll mounted on said main frame, and an operating roll which is parallel with and juxtaposed against the anvil roll, urging means for urging the operating roll against the anvil roll;

the machine incorporating a module which includes:

a sub-frame to which are mounted said operating roll and said urging means; and releasable securement means which in a first condition holds said sub-frame in a position in which the operating roll is juxtaposed against and parallel with the anvil roll, and which in a second condition releases the sub-frame and operating roll, allowing the operating roll to move away from the anvil roll to a position wherein the operating roll is directly accessible can be quickly and easily removed for replacement or maintenance, without having to dismantle said urging means.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
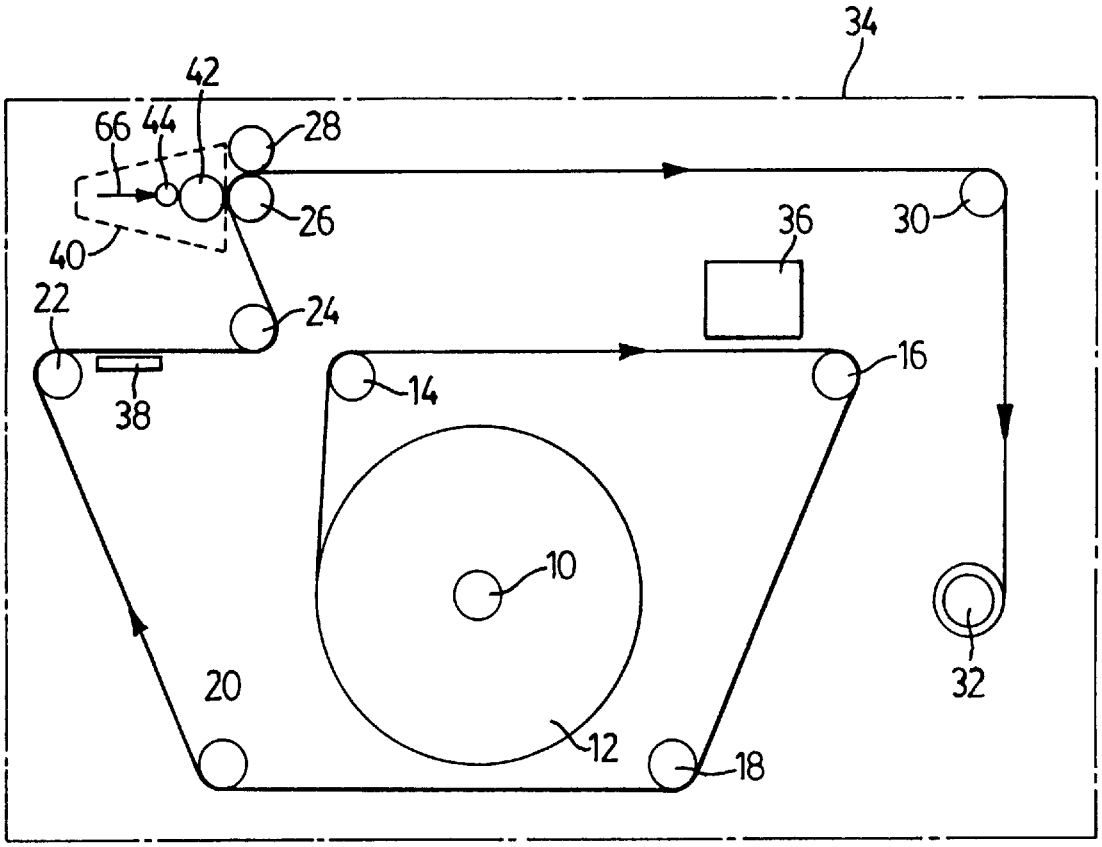
FIG. 1 is a simplified schematic elevational view of the main components of a typical inspection/converting machine retrofitted with the module of this invention.

Attention is first directed to FIG. 1, which is an elevational schematic view of a typical conventional web inspection/converting machine, to which the module of this invention can be applied.

In FIG. 1, an unwind mandrel 10 supports a roll 12 of web material. The web material is withdrawn from the roll 12, passes around a roll 14, thence around a series of idler rolls 16, 18, 20, 22 and 24, then passes through the nip between a driven draw roller 26 and a nip roller 28, thence passes around a further idler roller 30, thence to a rewind mandrel 32 around which it wraps to form a roll of web material. The frame of the tracker is represented by the broken line 34, and it is to be understood that all of the various rolls already described are mounted to the frame 34.

When this machine is used as an inspection machine, it employs a conventional inspection station represented by the box 36, and a repair station represented by the rectangle 38 between the idler rolls 22 and 24.

It is to be understood that the drawing in FIG. 1 is a simplified version of a typical inspection machine. It omits a number of features which have nothing to do with this invention, among which is the automatic mechanism for keeping the moving web in a centred position, a possible mechanism for slitting the web, and other minor components.

The inspection machine in FIG. 1 has been retrofitted with a module represented schematically by a broken-line, trapezoidal block 40.

In the retrofitted inspection machine, the roller 26, rather than being a driven draw roller, is a driven anvil roll against which a rotary tool 42 (such as a die roll) is urged by an overbearer assembly 44 which includes rotatable bearing means 46 at either end of a central rod 48. Each bearing means 46 presses against the rotary tool 42 at one of the respective ends thereof.

Figure 2:
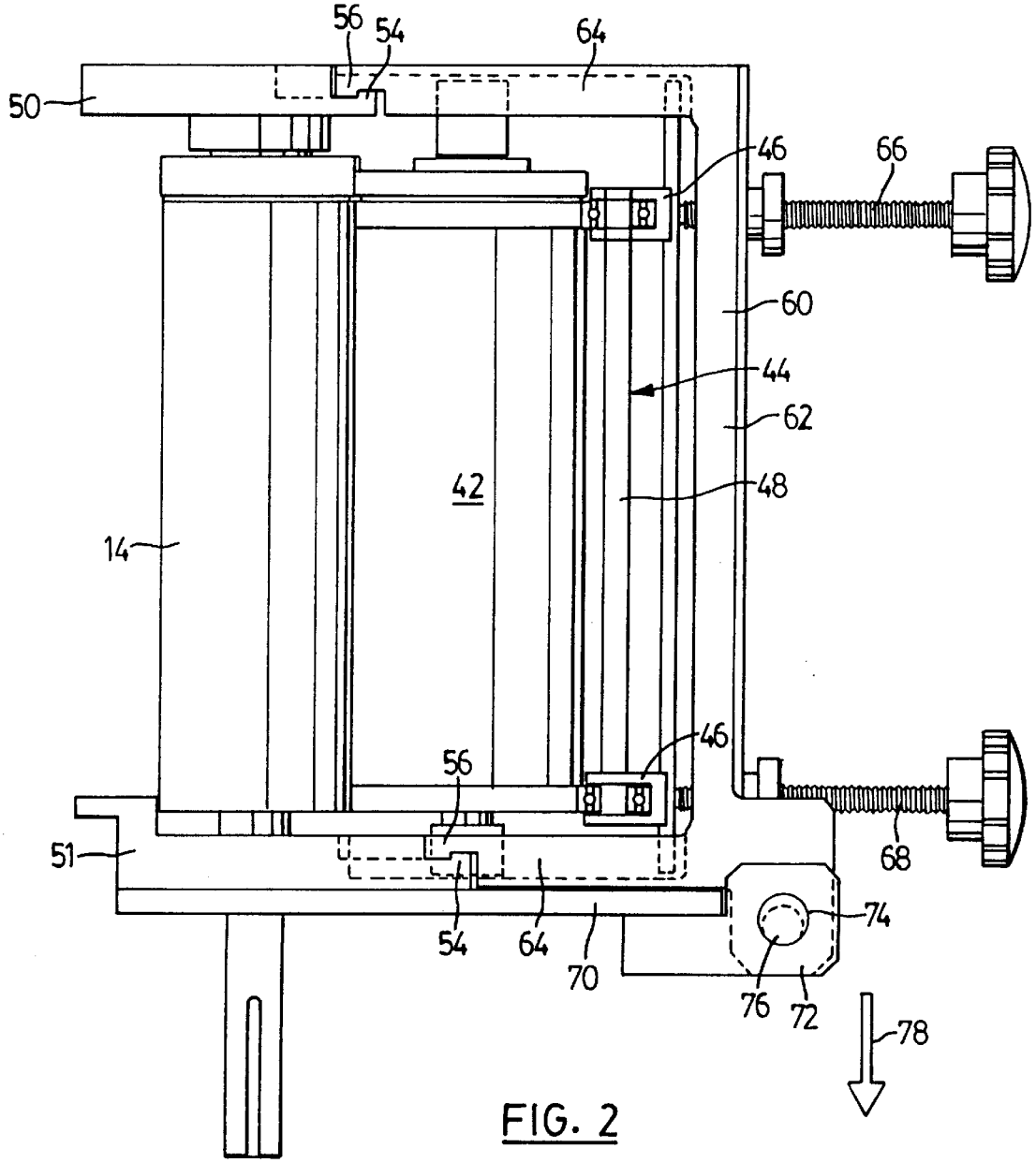
FIG. 2 is a plan view of the module of this invention, shown in the locked condition.

At the left in FIG. 2, two portions 50, 51 of the main frame are illustrated. Each portion 50, 51 includes a dovetail interlock portion 54 which is adapted to engage a similarly configured part 56 defined by a U-shaped sub-frame 60. The sub-frame 60 includes a central, transverse member 62 integral with two parallel arms 64.

Figure 3:
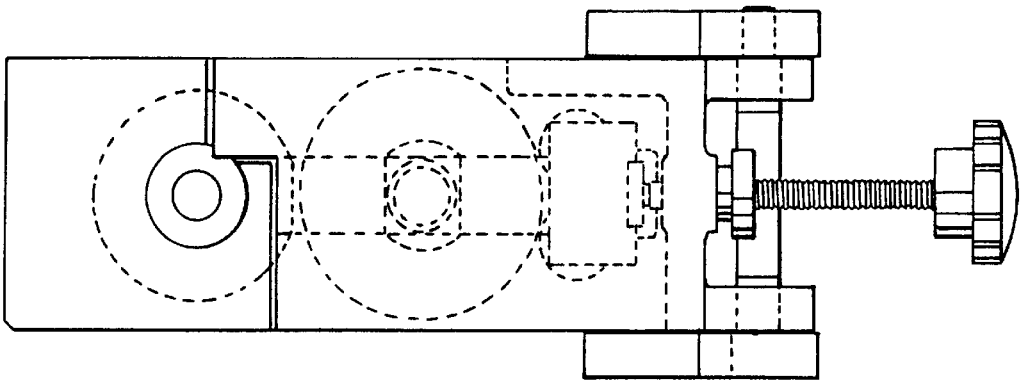
FIG. 3 is an end elevational view of the module seen in FIG. 2.

Clearly illustrated in FIGS. 2 and 3, are two load screws 66 and 68 which threadably engage internally threaded bores in the transverse member 62, each load screw being adapted to bear inwardly against one of the bearing assemblies 46.

The load screws 66, 68 fulfil two important functions: firstly, they load the die roll 42 against the anvil roll 14; secondly, they lock the U-shaped sub-frame 60 together with the main frame of the machine, thus rigidifying the sub-frame.

Attention is now directed to the bottom right-hand portion of FIG. 2 where it will be seen that the portion 51 of the main frame of the machine, in addition to defining the dove-tail portion 54, also incorporates an elongate portion 70 which (at the rightward end thereof in FIG. 2) in turn supports a pin bearing 72 through which passes a pin 74 having an eccentric intermediate land 76 which, when the pin 74 is rotated, causes the U-shaped sub-frame 60 to undergo partial circular motion with a relatively small radius, sufficient to disengage the parts 56 from the portions 54 (the dove-tail joints).

The eccentric land 76 is in its furthest "outward" position in FIG. 2, the "outward direction" being identified by the arrow 78 in FIG. 2.

Figure 4:
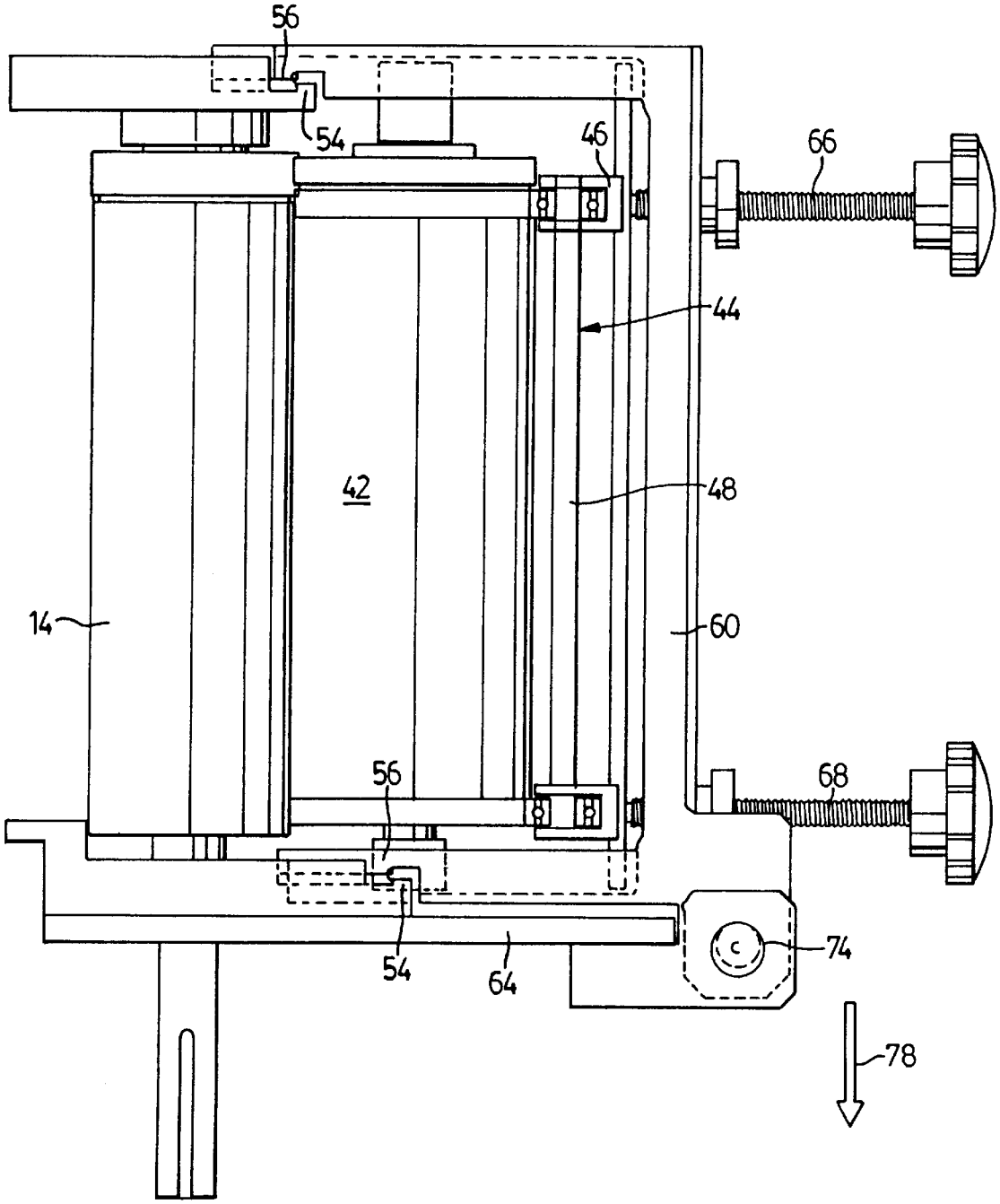
FIG. 4 is a view similar to that in FIG. 2, but shown in the unlocked condition.

If it is now imagined that the pin 74 rotates through 180° from the position shown in FIG. 2, the result will be that pictured in FIG. 4, in which the parts 56 are disengaged from the portions 54.

Figure 6:
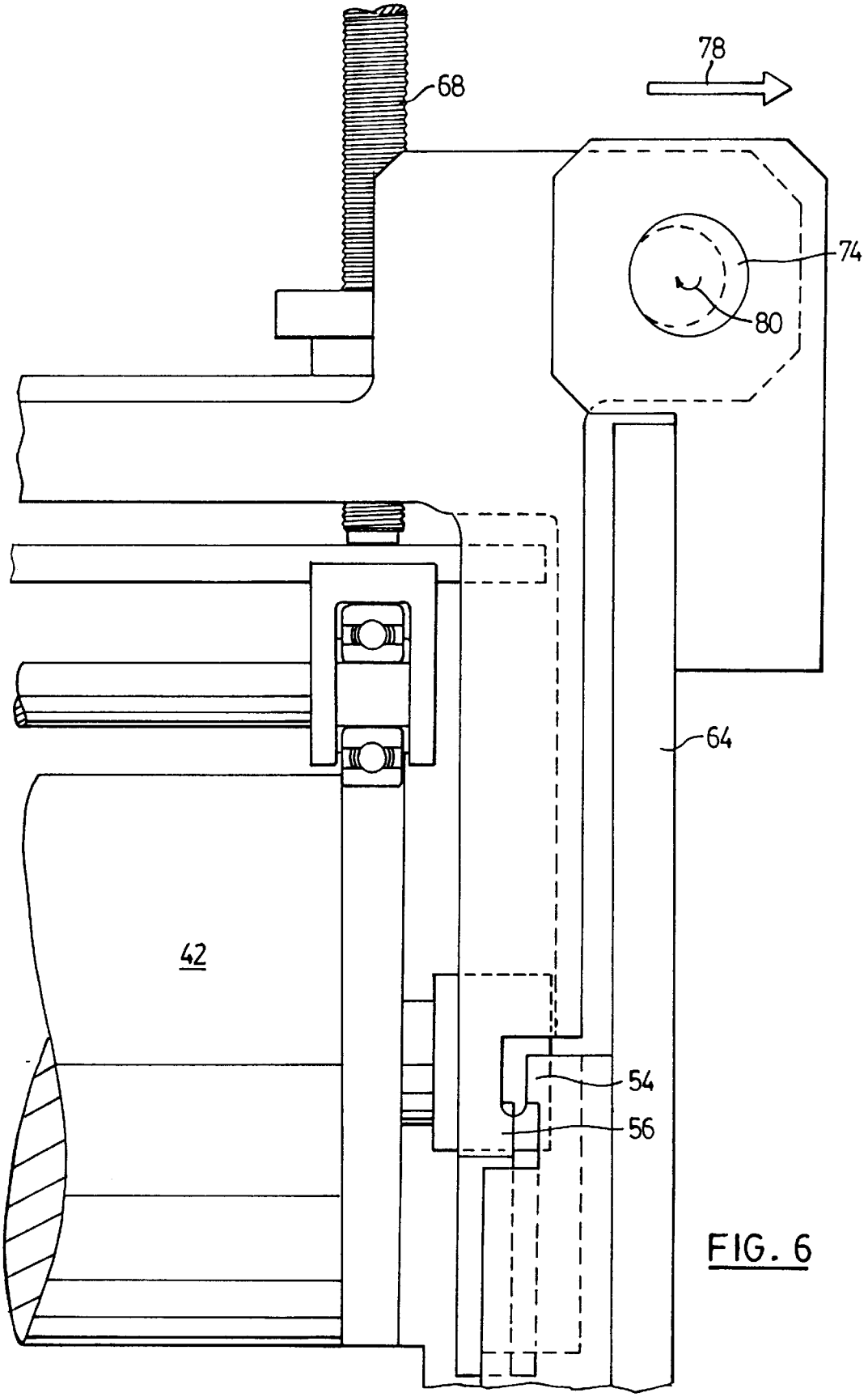
FIG. 6 is an enlarged view of the bottom right-hand portion of FIG. 4.

The semi-circular path followed by the sub-frame 60 is marked in FIG. 4, but is more clearly seen in FIG. 6, drawn to a larger scale. The semi-circular path is identified by the numeral 80.

Figure 5:
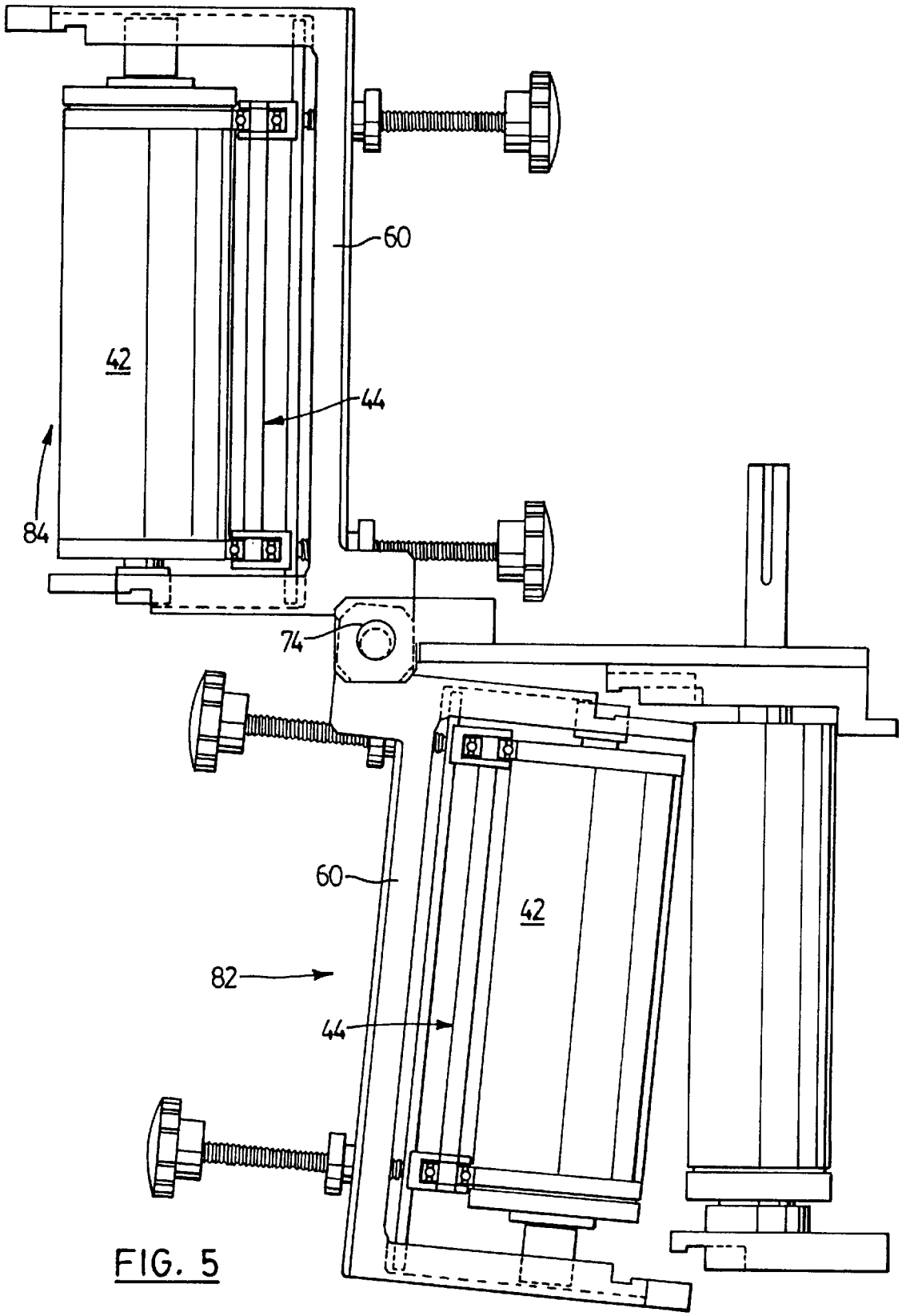
FIG. 5 is a plan view of the module of this invention, showing a hinge portion thereof in both an intermediate and a fully opened condition.

Attention is now directed to FIG. 5 which shows the sub-frame 60 (together with the rotary tool 42 and the overbearer assembly 44) in an intermediate position seen generally at the arrow 82, and a fully opened position shown generally at the arrow 84. It will be clear from FIG. 5 that the sub-frame 60 rotates about the pin 74.

It is thus apparent from the above that the pin 74 has two functions: firstly it latches and unlatches the dove-tail connection represented by the parts 56 and portions 54; secondly it acts as a main axis for swinging the sub-frame 60 through approximately 180°. When the sub-frame 60 is in the latter condition, (a) it presents the rotary tool 42 for removal and replacement, and (b) it assumes a position in which it is generally out of the way.

While one embodiment of this invention has been illustrated in the accompanying drawings and described hereinabove, it will be evident to those skilled in the art that changes and modifications may be made therein, without departing from the essence of this invention as set forth in the appended claims.

The Embodiments of the Invention in which an Exclusive Property or Privilege is claimed are defined as follows:

1. A module for use on a web-processing machine adapted to carry out operations on a moving web uncoiling from an unwind mandrel and coiling up on a rewind mandrel, the machine having a main frame and further having rolls which define a web path, said rolls including a driven anvil roll mounted on said main frame, an operating roll which is parallel with and juxtaposed against the anvil roll, and urging means for urging the operating roll against the anvil roll; the module comprising:

a sub-frame to which are mounted said operating roll and said urging means; and releasable securement means which in a first condition holds said sub-frame in a position in which the operating roll is juxtaposed against and parallel with the anvil roll, and which in a second condition releases the sub-frame and operating roll, allowing the operating roll to move away from the anvil roll to a position wherein the operating roll is directly accessible and can be quickly and easily removed for replacement or maintenance, without having to dismantle said urging means.

2. The module claimed in claim 1, in which said sub-frame is hinged to the main frame adjacent one end of the operating roll, about a hinge axis which is vertical and extends perpendicular to the direction of the axis of the operating roll.

3. The module claimed in claim 2, in which said releasable securement means includes: step-like, mutually engaging parts on the main frame and the sub-frame, a pin journalled for rotation with respect to the main frame and defining said hinge axis, the pin having an eccentric portion engaging said sub-frame so that rotation of the pin through less than a complete revolution causes the sub-frame to undergo a part-circular motion which disengages said step-like parts, whereupon the sub-frame can be swung about the pin to an open position in which the operating roll is accessible.

4. The module claimed in claim 1, in which the operating roll is a die-cutting roll.

5. The module claimed in claim 1, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

6. A web-processing machine adapted to carry out operations on a moving web, the machine comprising:

an uncoiling mandrel and a rewind mandrel disposed such that the web can uncoil from the unwind mandrel and coil up on the rewind mandrel, a main frame, a plurality of rolls which define a web path between said mandrels, said rolls including a driven anvil roll mounted on said main frame, and an operating roll which is parallel with and juxtaposed against the anvil roll, urging means for urging the operating roll against the anvil roll;

the machine incorporating a module which includes:

a sub-frame to which are mounted said operating roll and said urging means; and releasable securement means which in a first condition holds said sub-frame in a position in which the operating roll is juxtaposed against and parallel with the anvil roll, and which in a second condition released the sub-frame and operating roll, allowing the operating roll to move away from the anvil roll to a position wherein the operating roll is directly accessible and can be quickly and easily removed for replacement or maintenance, without having to dismantle said urging means.

7. The machine claimed in claim 6, in which said sub-frame is hinged to the main frame adjacent to one end of the operating roll, about a hinge axis which is vertical and extends perpendicular to the direction of the axis of the operating roll.

8. The machine claimed in claim 7, in which said releasable securement means includes: step-like, mutually engaging parts on the main frame and the sub-frame, a pin journalled for rotation with respect to the main frame and defining said hinge axis, the pin having an eccentric portion engaging said sub-frame so that rotation of the pin through less than a complete revolution causes the sub-frame to undergo a part-circular motion which disengages said step-like parts, whereupon the sub-frame can be swung about the pin to an open position in which the operating roll is accessible.

9. The machine claimed in claim 6, in which the operating roll is a die-cutting roll.

10. The module claimed in claim 6, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

11. The module claimed in claim 2, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

12. The module claimed in claim 3, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

13. The module claimed in claim 4, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

14. The module claimed in claim 7, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

15. The module claimed in claim 8, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

16. The module claimed in claim 9, in which the urging means includes: a plurality of manually rotatable screws which, when rotated in one sense, cause the operating roll to be loaded against the anvil roll, and simultaneously rigidly lock the sub-frame to the main frame; and when rotated in the opposite sense, the screws release both the loading of the operating roll and the locking of the sub-frame to the main frame.

* * * * *